US010505244B2

(12) United States Patent
Koo et al.

(10) Patent No.: US 10,505,244 B2
(45) Date of Patent: Dec. 10, 2019

(54) RF CAVITY FILTER USING ELASTIC ELEMENT AND METHOD FOR MANUFACTURING THE SAME

(71) Applicant: ACE TECHNOLOGIES CORPORATION, Incheon (KR)

(72) Inventors: Gwan Young Koo, Seoul (KR); Jin-Yang Kim, Incheon (KR); Se Young O, Incheon (KR); Seong Min Lee, Incheon (KR); Sin Jae Kim, Incheon (KR); Sung Soo Chung, Incheon (KR); Dong-Wan Chun, Incheon (KR); Jae Kwang Yoon, Incheon (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 0 days.

(21) Appl. No.: 15/919,817

(22) Filed: Mar. 13, 2018

(65) Prior Publication Data

US 2018/0269553 A1 Sep. 20, 2018

(30) Foreign Application Priority Data

Mar. 17, 2017 (KR) ..... 10-2017-0034095
Apr. 11, 2017 (KR) ..... 10-2017-0046587

(51) Int. Cl.

| | |
|---|---|
| ***H01P 1/208*** | (2006.01) |
| ***H01P 7/04*** | (2006.01) |
| ***H01P 7/06*** | (2006.01) |
| ***H01P 1/205*** | (2006.01) |

(52) U.S. Cl.

CPC ..... *H01P 1/208* (2013.01); *H01P 1/2053* (2013.01); *H01P 7/04* (2013.01); *H01P 7/06* (2013.01)

(58) Field of Classification Search

CPC ..... H01P 1/2053; H01P 1/208; H01P 7/04; H01P 7/06

USPC ..... 333/207, 209

See application file for complete search history.

(56) References Cited

U.S. PATENT DOCUMENTS 7,449,981 B2 * 11/2008 Park ..... H01P 1/205 333/203
2016/0233567 A1 8/2016 Tong et al.
2016/0315368 A1 * 10/2016 Liang ..... H01P 7/04

FOREIGN PATENT DOCUMENTS

| | | | |
|---|---|---|---|
| CN | 201749935 | U | 2/2011 |
| CN | 102623785 | A | 8/2012 |
| CN | 204927465 | U | 12/2015 |
| EP | 01760824 | B1 | 8/2010 |

(Continued)

*Primary Examiner* — Rakesh B Patel

(57) ABSTRACT

An RF cavity filter is disclosed. The disclosed filter includes: a housing in which there is at least one cavity formed; a cover joined to an upper portion of the housing; at least one bolt inserted through at least one through hole formed in the cover; and at least one elastic element attached to the cover in an area below the through hole, where the bolt is inserted through the through hole to provide an external force on the elastic element, and the external force alters the shape of the elastic element. With the disclosed filter, pieces of metal debris created during tuning can be prevented from reaching the inside of the filter, and the degradation in the PIMD performance that would have otherwise occurred due to the pieces of debris can be avoided. Also, the filter can maintain a tuned state without the use of separate nuts.

16 Claims, 16 Drawing Sheets

(56) References Cited

FOREIGN PATENT DOCUMENTS

| | | | |
|---|---|---|---|
| JP | 2002-542433 | A | 12/2002 |
| KR | 1020100079292 | A | 7/2010 |
| KR | 10-2015-0118768 | A | 10/2015 |
| KR | 1020160136783 | A | 11/2016 |
| KR | 1020180045413 | A | 5/2018 |

* cited by examiner

Self-locking achieved by recovery force

RF CAVITY FILTER USING ELASTIC ELEMENT AND METHOD FOR MANUFACTURING THE SAME

CROSS-REFERENCE TO RELATED APPLICATIONS

This application claims the benefit of Korean Patent Application No. 10-2017-0034095, filed with the Korean Intellectual Property Office on Mar. 17, 2017, and Korean Patent Application No. 10-2017-0046587, filed with the Korean Intellectual Property Office on Apr. 11, 2017, the disclosure of which is incorporated herein by reference in its entirety.

BACKGROUND

1. Technical Field

Embodiments of the present invention relate to a filter, more particularly to the tuning structure of an RF cavity filter using elastic elements and to a method of producing the same.

2. Description of the Related Art

A filter is a device for passing signals of only the desired frequency band and is being implemented in various forms. The band-pass frequency of an RF filter is determined by the inductance component and capacitance component of the filter. While a filter is designed to provide the desired band-pass properties based on proper configurations of the sizes of the cavities, number of cavities, structures of the resonators, and the like, processing tolerances and other factors may cause the filter not to provide the desired band-pass properties. To resolve this problem, a tuning process is needed after the manufacture of the filter.

FIG. 1 illustrates the tuning structure of an RF cavity filter according to the related art.

Referring to FIG. 1, an RF cavity filter according to the related art may include a housing 100, an input connector 102, an output connector 104, a cover 106, and multiple cavities 108 and resonators 110.

A number of partitions may be formed inside the filter, with the partitions defining cavities 108 in which the resonators may be held. The cover 106 may include fastening holes used for joining the housing 100 with the cover 106 and may also include tuning bolts 112.

The tuning bolts 112 may be joined to the cover 106 and may penetrate into the inside of the housing. A tuning bolt 112 may be arranged on the cover 106 in a position corresponding to the position of a resonator or a particular position of the inside of a cavity.

RF signals may be inputted via the input connector 102 and outputted via the output connector 104, the RF signals proceeding through coupling windows formed in the cavities. Each cavity 108 and resonator 110 create resonance for the RF signals, whereby the RF signals may be filtered by the resonance phenomenon.

FIG. 2 is a cross-sectional view of a cavity in an RF cavity filter according to the related art.

Referring to FIG. 2, a tuning bolt 112 may penetrate through the cover 106. The tuning bolt 112 may be made of a metallic material, and threads may be formed both on the outer perimeter of the tuning bolt and the inner perimeter of the through hole in the cover, so that the insertion depth of the tuning bolt may be determined by rotating the tuning bolt 112.

According to the insertion depth of the tuning bolt 112, the distance between the resonator and the tuning bolt 112 can be adjusted, with tuning achieved by such varying of the insertion depth. The tuning bolt 112 can be rotated manually, or a separate tuning machine can be used.

When the tuning is complete, the tuning bolt may be secured, and a nut may be used, as illustrated in FIG. 1, to finally secure the tuning bolt.

This conventional tuning method using tuning bolts involves repeatedly moving the tuning bolts up and down, and as a result, small pieces of debris from the plating or material itself can fall inside the filter. Such pieces of debris within the filter may become a major cause of degraded PIMB performance of the filter.

Also, where the tuning bolts are secured with nuts after the tuning is complete, the process of a worker securing each and every nut is a process that requires considerable time and cost and increases the overall production cost.

SUMMARY OF THE INVENTION

An aspect of the present invention aims to provide an RF cavity filter that prevents pieces of metal debris, created during tuning, from reaching the inside of the filter and degrading the PIMD performance of the filter.

Also, an aspect of the invention aims to provide an RF cavity filter capable of maintaining a tuned state without using separate nuts.

Furthermore, an aspect of the invention aims to provide an RF cavity filter that can improve the production yield of the filter, allowing improved productivity while satisfying PIMD requirements.

One aspect of the invention provides an RF cavity filter that includes: a housing in which there is at least one cavity formed; a cover joined to an upper portion of the housing; at least one bolt inserted through at least one through hole formed in the cover; and at least one elastic element attached to the cover in an area below the through hole, where the bolt is inserted through the through hole to provide an external force on the elastic element, and the external force alters the shape of the elastic element.

The RF cavity filter may further include at least one resonator held in the at least one cavity.

Threads may be formed in the outer perimeter of the at least one bolt and the inner perimeter of the at least one through hole, and the bolt may be inserted downward by rotation to provide the external force on the elastic element.

The size of the elastic element may be configured to be relatively larger than the through hole, and the elastic element may be attached to the cover by at least one of soldering, welding, and brazing applied to an edge area of the elastic element.

The elastic element may have a generally plate-like form and may have a partially downwardly protruding structure and a furrowed structure.

The elastic element may have the partially downwardly protruding structure and the furrowed structure in an area other than an area of contact with the bolt.

The bolt may contact a center area of the elastic element to provide the external force on the elastic element.

The furrowed structure may include a structure in which a multiple number of furrows are formed concentrically.

The diameter of the furrowed structure may be configured to be relatively smaller than the resonator.

In the cover, at least one hole may be formed for discharging pieces of debris that may be created during tuning.

Another aspect of the invention provides an RF cavity filter that includes: a housing in which at least one cavity is formed; a cover joined to an upper portion of the housing; at least one elastic element joined to a lower portion of the cover, where the elastic element is altered in shape by an external force.

The RF cavity filter may further include at least one through hole formed in the cover and at least one bar inserted through the at least one through hole, where the bar may provide the external force on the elastic element as the bar is inserted.

Still another aspect of the invention provides an RF cavity filter that includes: a housing having in which at least one cavity is formed; a cover joined to an upper portion of the housing; at least one resonator joined to a bottom portion of the cavity; at least one bolt inserted through at least one through hole formed in the resonator; and at least one elastic element attached to an upper portion of the resonator, where the bolt is inserted through the through hole to provide an external force on the elastic element, and the external force alters a shape of the elastic element.

Yet another aspect of the invention provides an RF cavity filter that includes: a housing having in which at least one cavity is formed; a cover joined to an upper portion of the housing; at least one resonator joined to a bottom portion of the cavity; and at least one elastic element attached to an upper portion of the resonator, where the elastic element is altered in shape by an external force.

According to an embodiment of the invention, pieces of metal debris created during tuning are prevented from reaching the inside of the filter, and the degradation in the PIMD performance of the filter that would have otherwise occurred due to the pieces of debris can be avoided.

Also, according to an embodiment of the invention, the RF cavity filter can maintain a tuned state without the use of separate nuts.

In addition, an embodiment of the invention can improve the production yield of the filter, allowing improved productivity while satisfying PIMD requirements.

Additional aspects and advantages of the present invention will be set forth in part in the description which follows, and in part will be obvious from the description, or may be learned by practice of the invention.

DETAILED DESCRIPTION OF THE INVENTION

Figure 1:
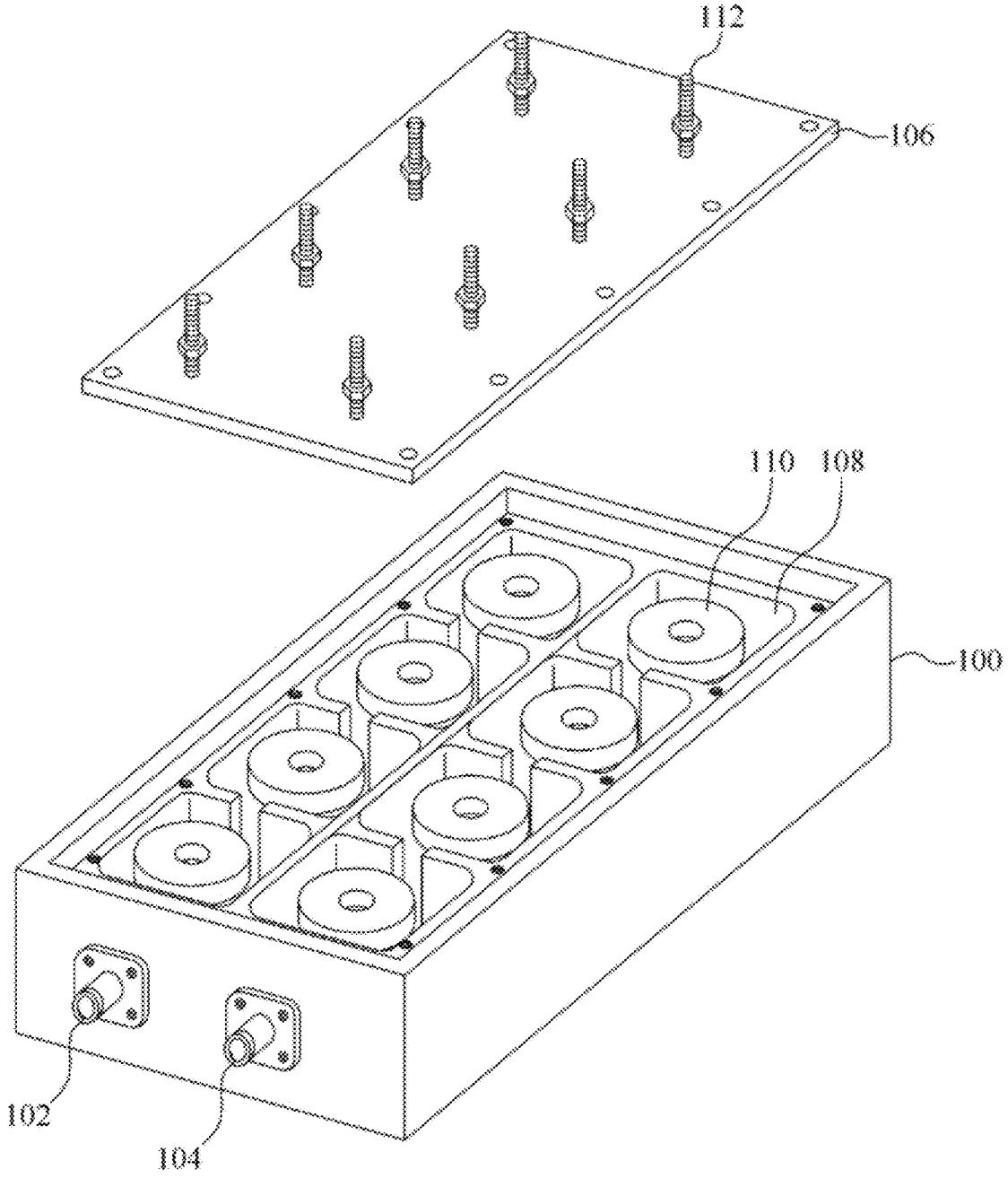
Prior Art Fig. 1
FIG. 1 illustrates the tuning structure of an RF cavity filter according to the related art.
Figure 2:
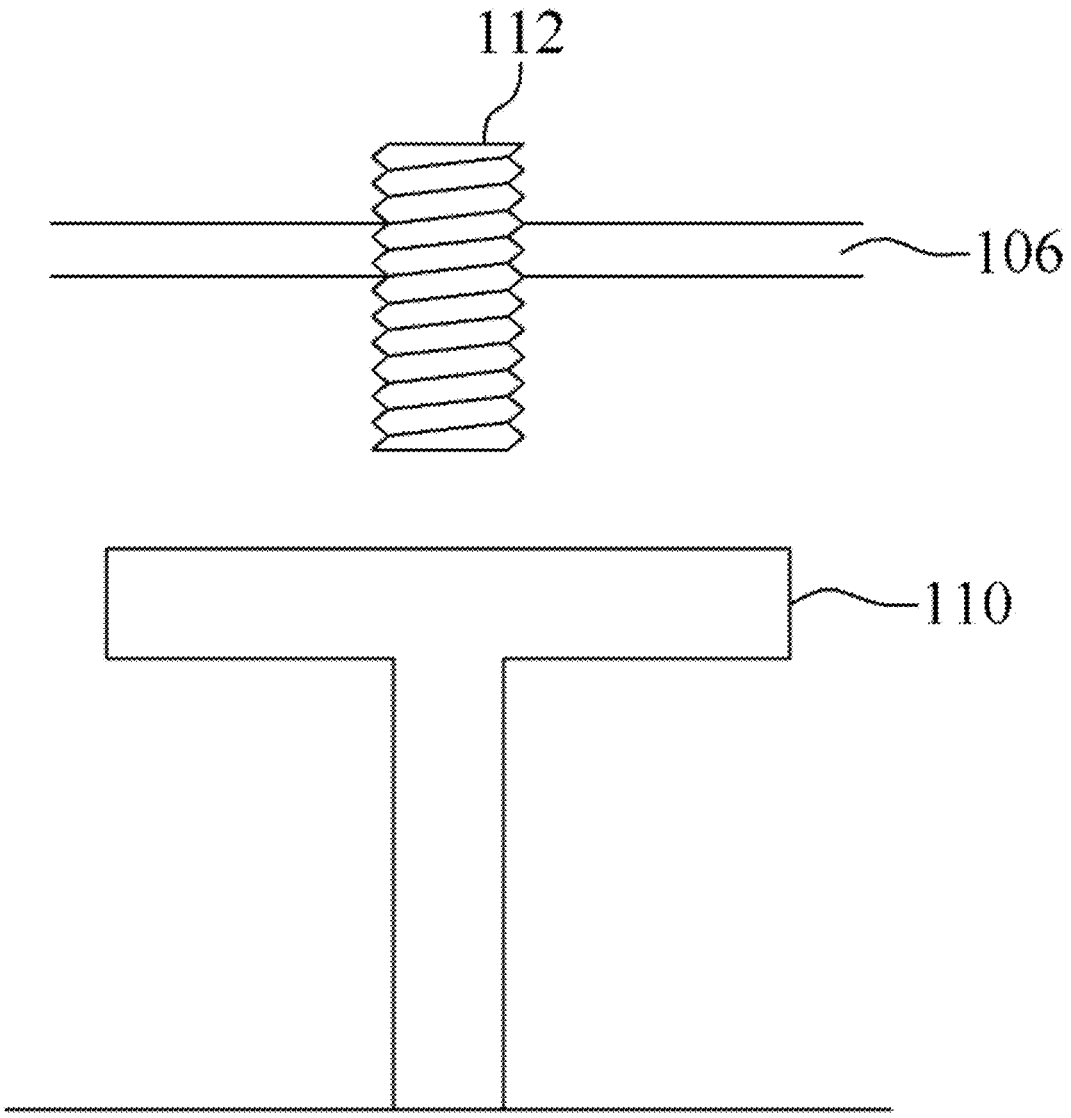
Prior Art Fig. 2
FIG. 2 is a cross-sectional view of a cavity in an RF cavity filter according to the related art.

As the invention allows for various changes and numerous embodiments, specific embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In describing the drawings, similar reference numerals are used for similar elements.

Certain embodiments of the invention are described below in more detail with reference to the accompanying drawings.

Figure 3:
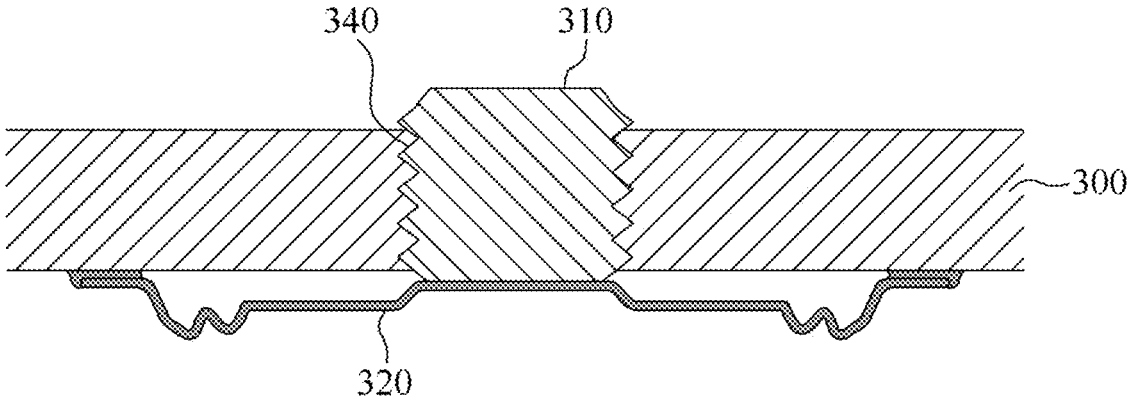
FIG. 3 illustrates the tuning structure of an RF cavity filter according to an embodiment of the present invention.

FIG. 3 illustrates the tuning structure of an RF cavity filter according to a first disclosed embodiment of the present invention.

Referring to FIG. 3, an RF cavity filter according to the first disclosed embodiment of the invention can include a cover 300, a bolt 310, and an elastic plate 320.

This embodiment of the invention has the tuning bolt of the related art replaced by the bolt 310 and the elastic plate 320.

The cover 300 can be made of a metallic material and can be joined with the housing at an upper portion of the housing, being joined with the housing for example by way of bolts, soldering, etc. This joining of the cover 300 and the housing renders the inside of the filter shielded.

In the cover 300, a multiple number of through holes 340 may be formed, and bolts 310 may be inserted through the through holes 340. In one example, threads can be formed in the outer perimeter of the bolts 310 and the inner perimeters of the through holes 340, and the bolts can be inserted through the through holes 340 by rotating the bolts 310.

Of course, it should be apparent to the skilled person that various structures other than the structure described above can be employed for inserting the bolts through the holes.

Below a through hole (i.e. inside the filter when the cover is fastened), an elastic plate 320 may be attached to the cover 300 of the filter.

The size of the elastic plate may be configured to be larger than the through hole, and as a result, the filter may be shielded from the exterior when regarding the through hole from outside the filter. While various methods can be used for attaching the elastic plate 320 with the cover, some examples may use a method of soldering, welding, brazing, riveting, etc., or a comparable method for attaching to the filter cover.

Figure 4A:
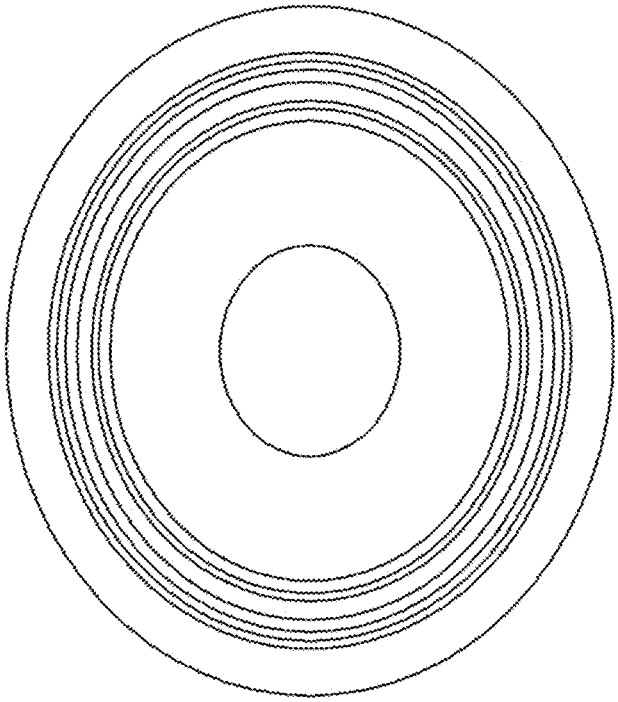
FIG. 4A and FIG. 4B are plan views illustrating the structure of an elastic plate according to an embodiment of the present invention.
Figure 4B:
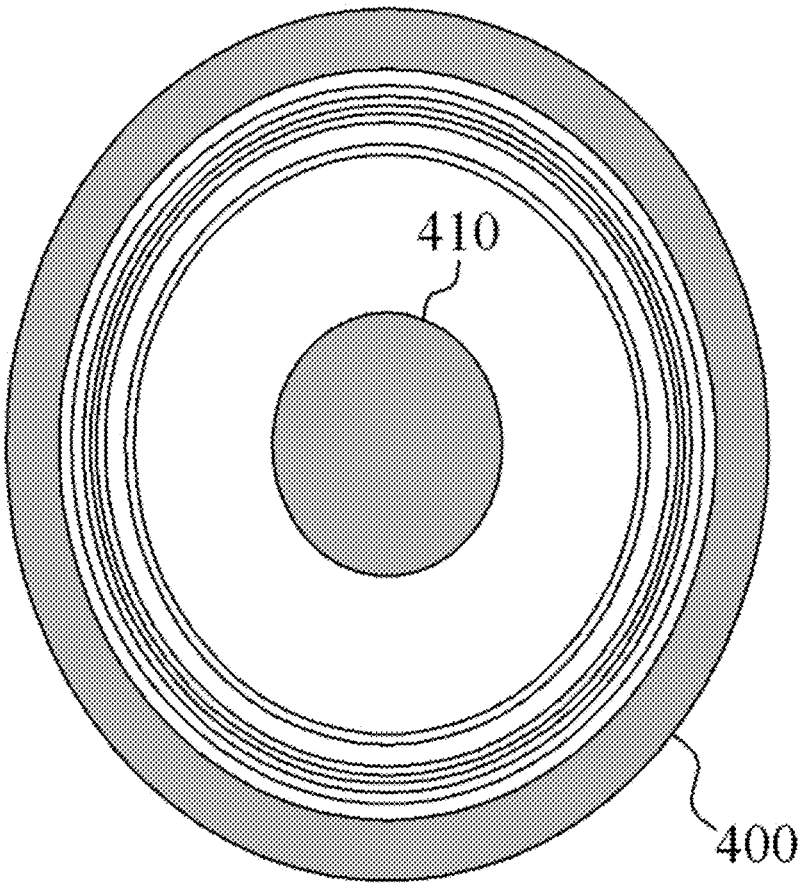

FIG. 4A and FIG. 4B are plan views illustrating the structure of an elastic plate according to an embodiment of the present invention.

FIG. 4A illustrates the structure of an elastic plate, and FIG. 4B marks the portion of the elastic plate contacting the bolt and the soldering area.

Referring to FIG. 4A, the elastic plate 320 can have a circular shape and can be implemented with an elastic material that can be altered in shape when an external force is applied. According to an embodiment of the invention, a partial area of the elastic plate 320 can have a higher elastic coefficient compared to other areas, and by virtue of this structure, the deformation in shape caused by the external force can be controlled. This means that different areas can have different coefficients of elasticity, and the coefficient of elasticity in each area can be suitably adjusted according to the form of deformation required. Of course, it should be apparent to the skilled person that the elastic plate 320 can also be implemented as a flat spring that does not have different coefficients of elasticity in different areas.

Referring to FIG. 4B, the edge area 400 of the elastic plate 320 is marked in a darker color. This area corresponds to the area where the soldering, etc., may be applied when the elastic plate 320 is attached to the cover 300 by soldering, etc. It may be preferable that the attaching using soldering, etc., be applied only at the edge area in order that the elastic plate may be able to undergo an elastic shape deformation, and the soldering area can be selected in consideration of the required degree of deformation and attachment strength.

In FIG. 4B, the center area 420 of the elastic plate 320 is marked in a darker color, and this area is where the elastic plate 320 is pressed by a bolt.

Referring to FIG. 3, FIG. 4A, and FIG. 4B, while the elastic plate 320 basically has the shape of a circular plate, a partial area may be folded to form a downwardly protruding structure and a furrowed structure. According to an embodiment of the invention, the center area that contacts the tuning bolt may not protrude downward, and the outer area may be folded to form the downwardly protruding structure and furrowed structure. Of course, the downwardly protruding area and the area of the furrowed structure can be configured differently as needed.

If the downwardly protruding structure and furrowed structure were not applied, there would be a limit to the degree of deformation that the elastic element may undergo when the external force from the tuning bolt is applied. In particular, as described in further detail later on, it may be necessary to implement a greater shape alteration at the center area of the elastic plate. To provide a broader range of tuning, there is a need for increasing the degree of deformation of the elastic element, and due to this need, the downwardly protruding structure and furrowed structure may be applied to the elastic plate.

Therefore, the structure of the elastic plate 320 can have some parts folded, according to the range of tuning required, while maintaining a basically plate-like shape. Although FIG. 3, FIG. 4A, and FIG. 4B illustrate an elastic plate 320 of a circular shape, it should be apparent to the skilled person that the form of the elastic plate is not limited to a circular shape.

Referring again to FIG. 3, the bolt 310 can be inserted downward by way of rotation, and as it is inserted downwards, the bolt 310 may press the elastic plate 320. When the external force from the bolt is applied on the elastic plate 320, the shape of the elastic plate 320 may be altered due to its elasticity.

For example, as the bolt 310 applies an external force in a downward direction, the elastic plate 320 may also be stretched in a downward direction. Such change in the shape of the elastic plate 320 may alter the resonance frequency of the filter, thereby enabling tuning.

According to an embodiment of the invention, the material of the elastic plate 320 can be beryllium copper (BeCu) or stainless steel (STS301 or STS304). Of course, it should be apparent to the skilled person that various types of materials having an elastic quality can be applied for the elastic plate 320.

The thickness of the flat spring can be selected appropriately to maintain the elastic and recovery forces of the flat spring and can be, for example, a thickness of about 0.2 mm but is not limited thus. The parts that are folded to form the downwardly protruding structure and furrowed structure can have a suitably rounded structure.

Figure 5:
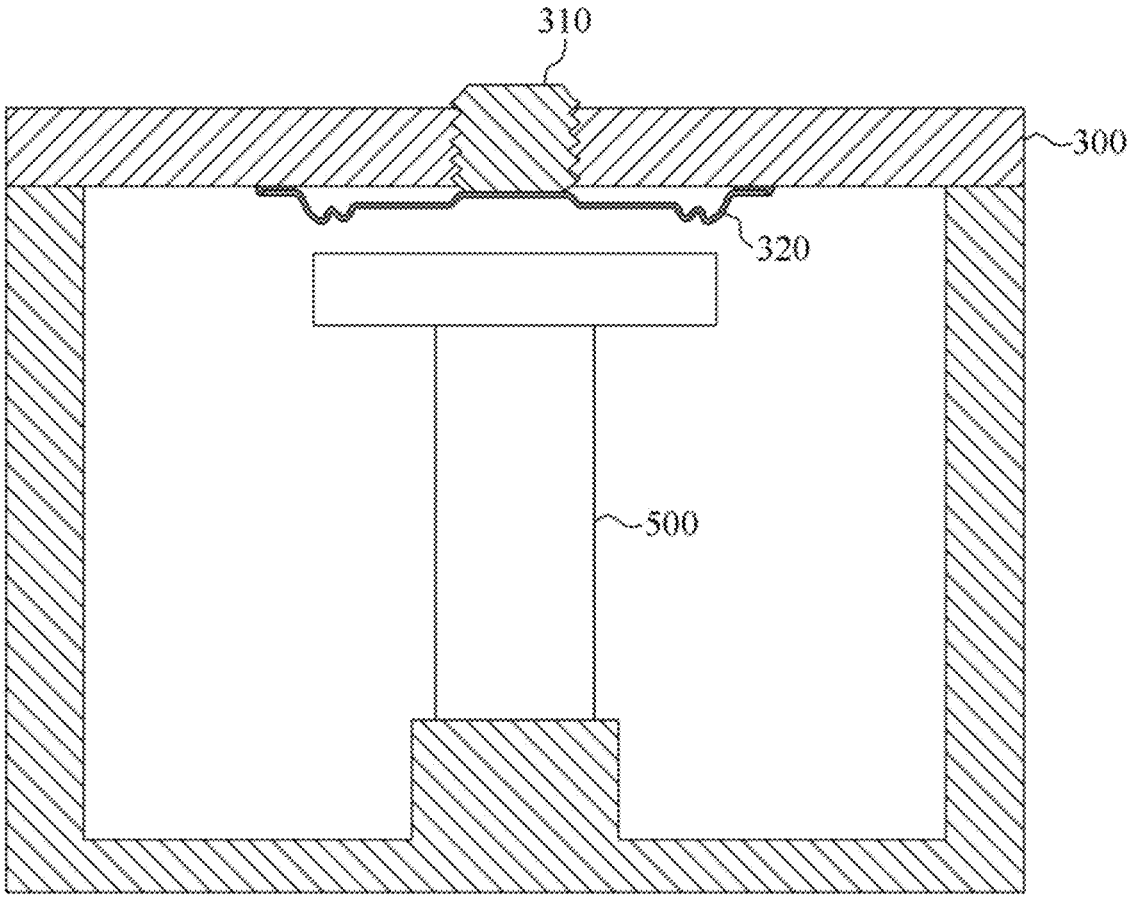
FIG. 5 is a cross-sectional view of a cavity according to an embodiment of the present invention.

FIG. 5 is a cross-sectional view of a cavity according to the first disclosed embodiment of the present invention.

Referring to FIG. 5, a resonator 500 may be installed below the elastic plate 320. While the illustration in FIG. 5 shows a resonator of a disk form, it should be apparent to the skilled person that a resonator of a different shape can be used. Likewise, the material for the resonator can be selected from various types.

While FIG. 5 illustrates a structure in which the center part of the elastic plate 320 is aligned with the center part of the resonator 500, a person of ordinary skill in the field of RF cavity filters would readily understand that the invention is not limited to such a structure.

FIG. 5 illustrates the elastic plate 320 in a normal state where there is no external force applied by the bolt. As illustrated in FIG. 5, the elastic plate may be structured such that the center area of the elastic plate contacting the bolt 310 does not protrude downward before an external force is applied.

Figure 6A:
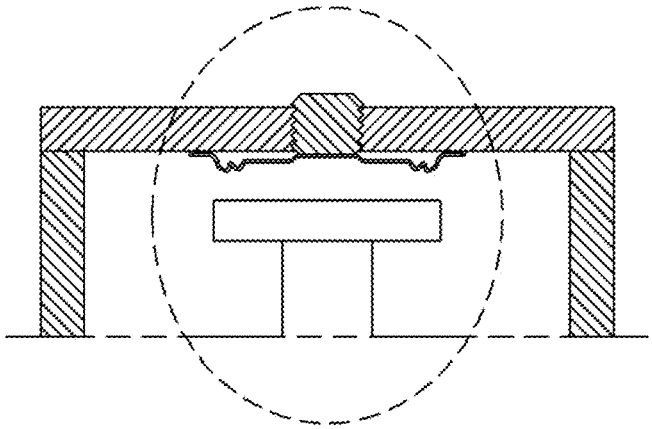
FIG. 6A and FIG. 6B illustrate an RF cavity filter according to an embodiment of the present invention, comparing the cases where there is and is not an external force applied by a bolt.
Figure 6B:
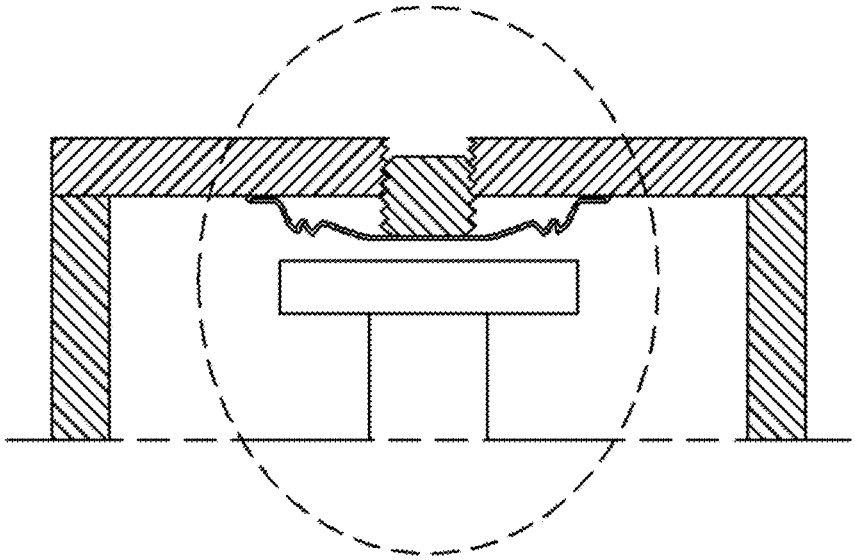

FIG. 6A and FIG. 6B illustrate an RF cavity filter according to the first disclosed embodiment of the present invention, comparing the cases where there is and is not an external force applied by a bolt.

FIG. 6A illustrates the case where there is no external force applied by way of the bolt, and FIG. 6B illustrates the case where there is an external force applied by way of the bolt.

Referring to FIG. 6A and FIG. 6B, it can be seen that when the bolt is deeply inserted to apply an external force on the elastic plate 320, the shape of the elastic plate 320 may be altered. It can be seen from FIG. 6B that the center area of the elastic plate 320 where the external force is applied receives a downward force as the bolt 310 is inserted, which causes the elastic element 320 to be stretched in a downward direction.

This stretching of the elastic plate 320 in a downward direction results in a change in the distance between the elastic plate 320 and the resonator. Comparing FIG. 6A with FIG. 6B, the distance between the elastic plate and the resonator is shorter in FIG. 6B than in FIG. 6A.

Such change in distance between the resonator 500 and the elastic plate 320 enables a tuning of band-pass properties.

According to a preferred embodiment of the invention, the structure of multiple furrows can be formed as concentric circles in order to maximize the deformation when the bolt 310 presses the elastic plate 320. Preferably, the furrowed structure can be formed with concentric circles of diameters greater than that of the resonator, as such structure can maximize the range in which the elastic plate may be stretched downward when the external force is applied by the bolt 310 on the elastic plate 320.

Figure 7:
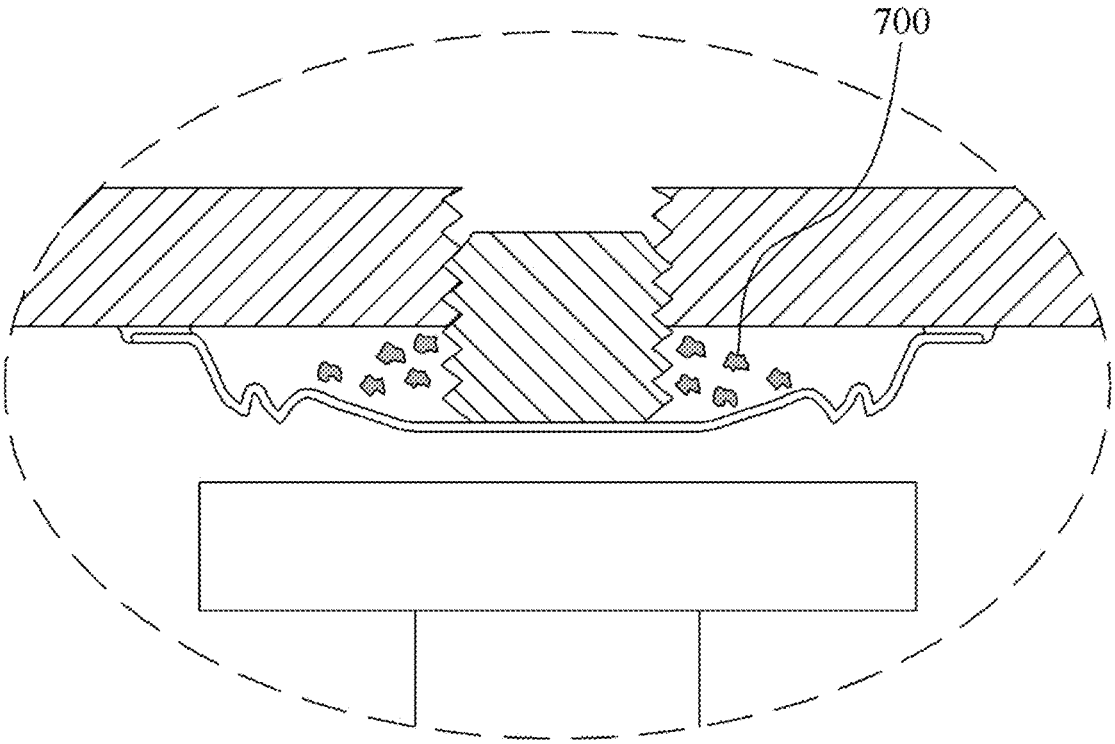
FIG. 7 illustrates the effect of preventing the degradation of PIMB properties in an RF cavity filter according to an embodiment of the present invention.

FIG. 7 illustrates the effect of preventing the degradation of PIMD properties in an RF cavity filter according to the first disclosed embodiment of the present invention.

Referring to FIG. 7, as the bolt is inserted or withdrawn by rotation, small pieces of metal debris 700 can be created. For an RF cavity filter according to the related art, there has as yet been no structure proposed that can prevent such pieces of metal debris from entering into the filter and degrading PIMD properties.

With an embodiment of the invention, however, the elastic plate 320 may serve as a kind of screen that prevents the pieces of metal debris 700 from reaching the inside of the filter and therefore significantly prevents the degrading of PIMD properties.

Figure 8:
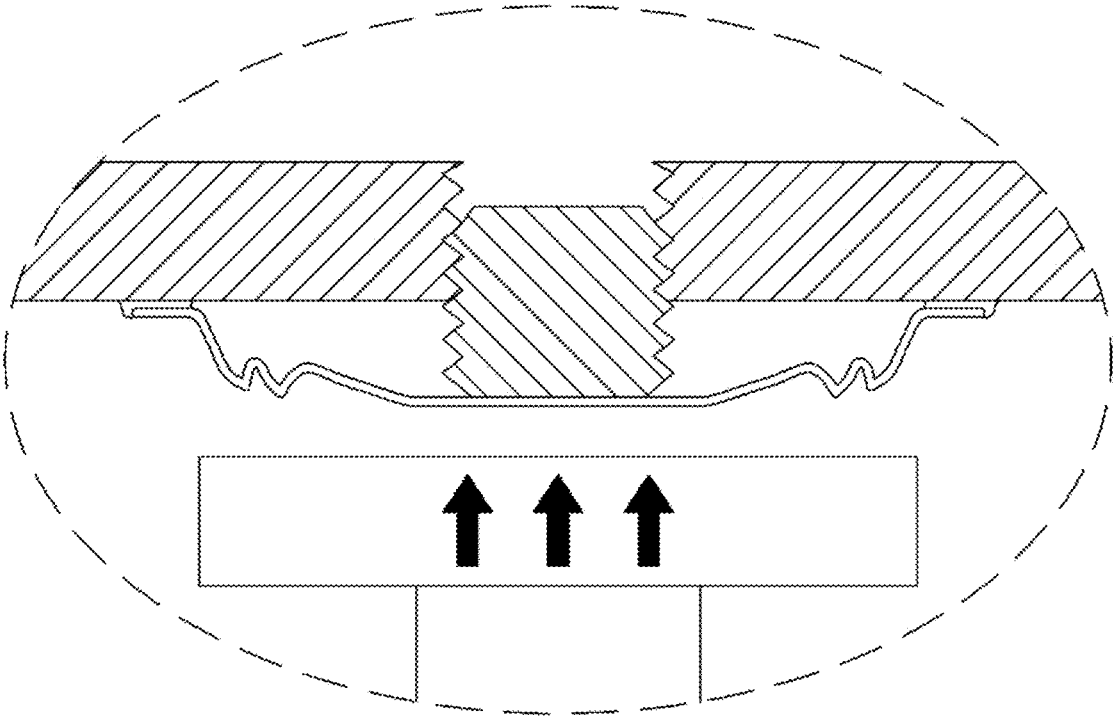
FIG. 8 illustrates the self-locking effect in an RF cavity filter according to an embodiment of the present invention.

FIG. 8 illustrates the self-locking effect in an RF cavity filter according to the first disclosed embodiment of the present invention.

Referring to FIG. 8, when the bolt 310 presses and alters the shape of the elastic plate 320, a recovery force is generated in the elastic plate 320 due to its elasticity. As illustrated in FIG. 8, this recovery force may be applied in an upward direction, and the upward recovery force can allow the bolt 310 to maintain its current state. Thus, due to the recovery force, an RF cavity filter based on the present invention is capable of self-locking even if there are no nuts used. This self-locking structure can eliminate production costs that would otherwise have been incurred by the inefficiency of having to fasten and release the nuts. Moreover, if the structure is used in cooperation with a tuning machine, the effects can be increased even further.

Figure 9:
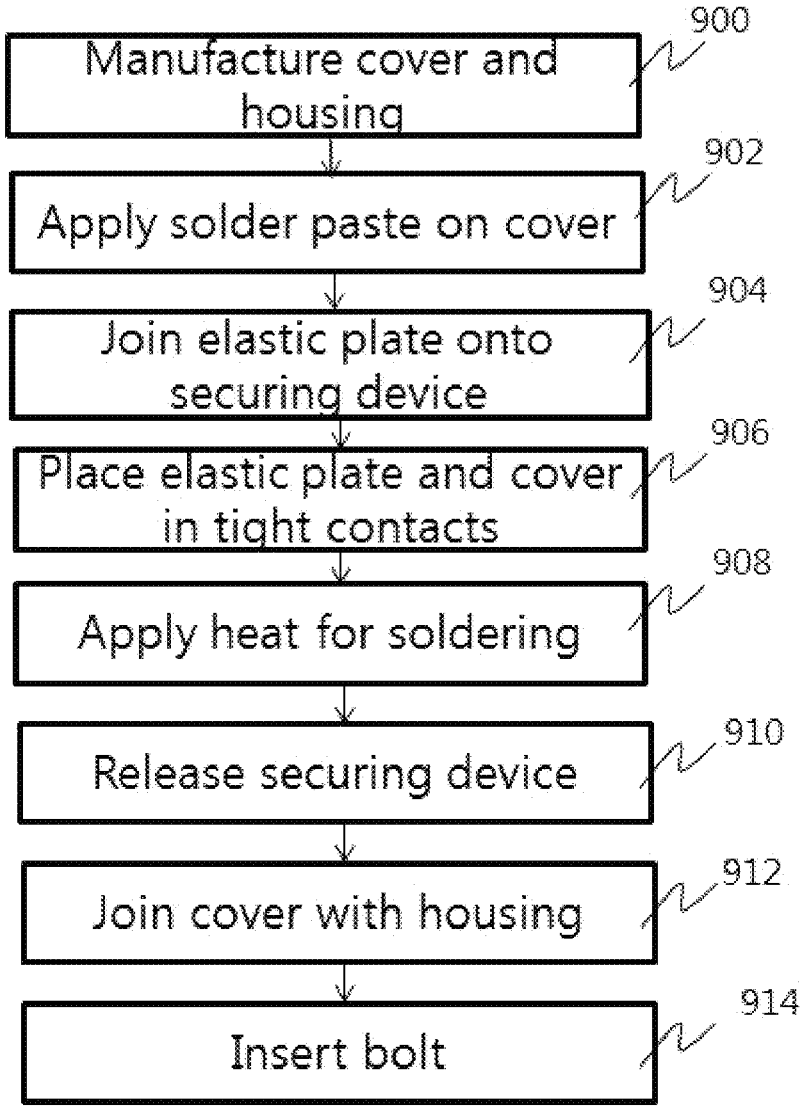
FIG. 9 is a flowchart illustrating the overall flow of a method for manufacturing an RF cavity filter using elastic elements according to an embodiment of the present invention.

FIG. 9 is a flowchart illustrating the overall flow of a method for manufacturing an RF cavity filter using elastic elements according to the first disclosed embodiment of the present invention.

Referring to FIG. 9, the housing of the filter having cavities formed within and a cover may be manufactured independently (operation 900).

When the cover is manufactured, the cover may be secured, and solder paste may be coated over the portions of the cover where the elastic plates are to be joined (operation 902). The solder paste can also be coated over the edge areas of the elastic plates as necessary.

The elastic plates may be joined to a securing device such as a jig (operation 904).

The cover and the securing device securing the elastic plates may be pressed together in tight contact, so that the elastic plates and the cover are pressed together in tight contact (operation 906). For instance, the cover and the jig that secures the elastic plates may be fastened together with bolts, etc., to keep the elastic plates and the cover in tight contact.

With the elastic plates and the cover kept in tight contact, heat may be applied to perform soldering (operation 908). The heating operation can be performed in various ways; for example, the heating can be performed in a device such an oven.

When the soldering by the heating is complete, the securing device such as a jig may be released (operation 910).

With the elastic plates joined to the cover, the resonators may be fastened to the housing, and the cover may be joined with the housing (operation 912).

When the cover and the housing are joined together, bolts may be inserted through the through holes formed in the cover (operation 914).

Figure 10:
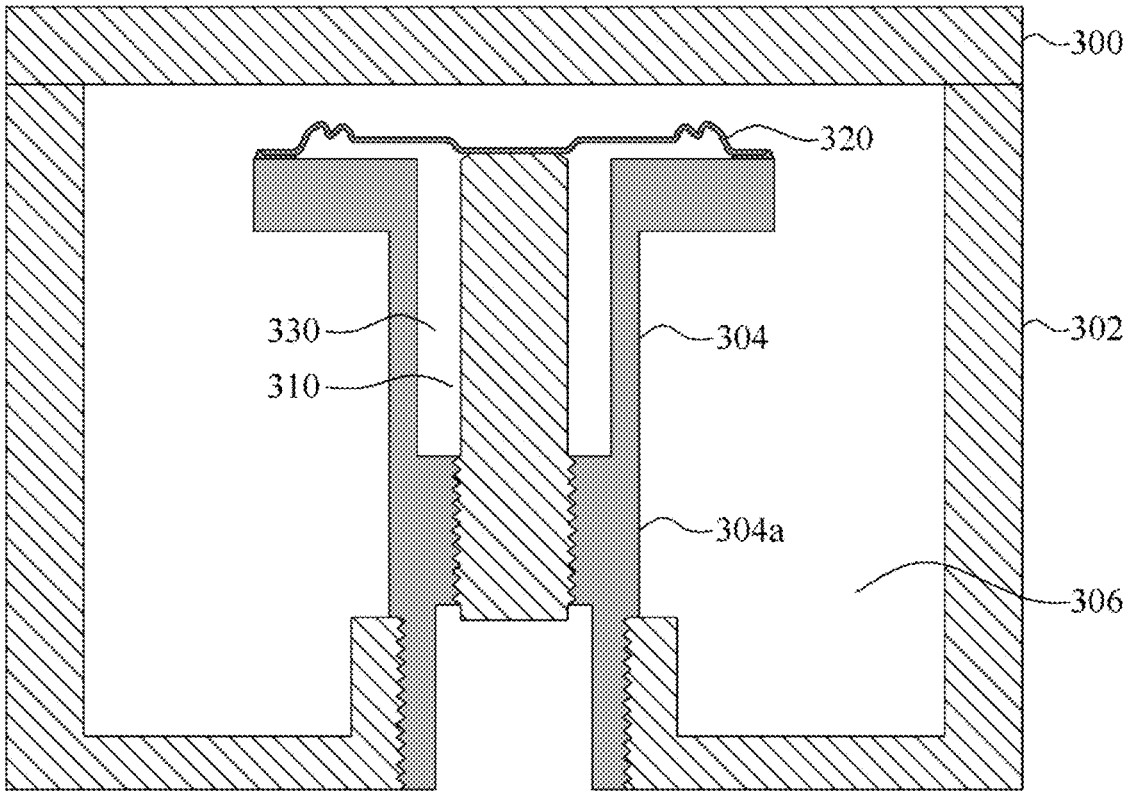
FIG. 10 is a cross-sectional view of a cavity in an RF cavity filter according to a second disclosed embodiment of the present invention.

FIG. 10 is a cross-sectional view of a cavity in an RF cavity filter according to a second disclosed embodiment of the present invention.

Referring to FIG. 10, an RF cavity filter according to the second disclosed embodiment of the invention can include a cover 300, a housing 302, a resonator 304, a bolt 310, and an elastic plate 320.

Compared to the first disclosed embodiment described above, the second disclosed embodiment illustrated in FIG. 10 has the structural difference that the elastic plate 320 is joined to an upper portion of the resonator 304.

The cover 300 may be made of a metallic material and may be joined with the housing 302. Methods such as bolt fastening, soldering, etc., can be used for joining the cover 300 with the housing 302. As the cover 300 is joined with the housing 302, the filter may form a shielded structure such that electromagnetic waves cannot penetrate inside from the outside.

In an RF cavity filter according to the second disclosed embodiment of the invention, a resonator 304 may be installed in each cavity 306. Various forms of resonators are known which can be used in an RF cavity filter, and any known form of resonator can be applied to an RF cavity filter according to the second disclosed embodiment of the invention. Also, the material of the resonator can be selected from a variety of types according to the resonance mode and properties required.

The resonator 304 may be secured to a bottom portion of the housing 302. Various methods can be used for joining the resonator 304 with the bottom portion of the housing 302, and FIG. 10 shows a structure using a screw joint as an example.

For example, the parts of the resonator 304 and the bottom portion of the housing 302 where the two are joined together can have protruding forms, a hole for the joining with the resonator 304 can be formed in the protruding part, and threads can be formed in the inner perimeter of the hole and the outer perimeter of the part of the resonator joining the housing, so that the resonator may be joined to the housing via a screw joint.

Figure 11:
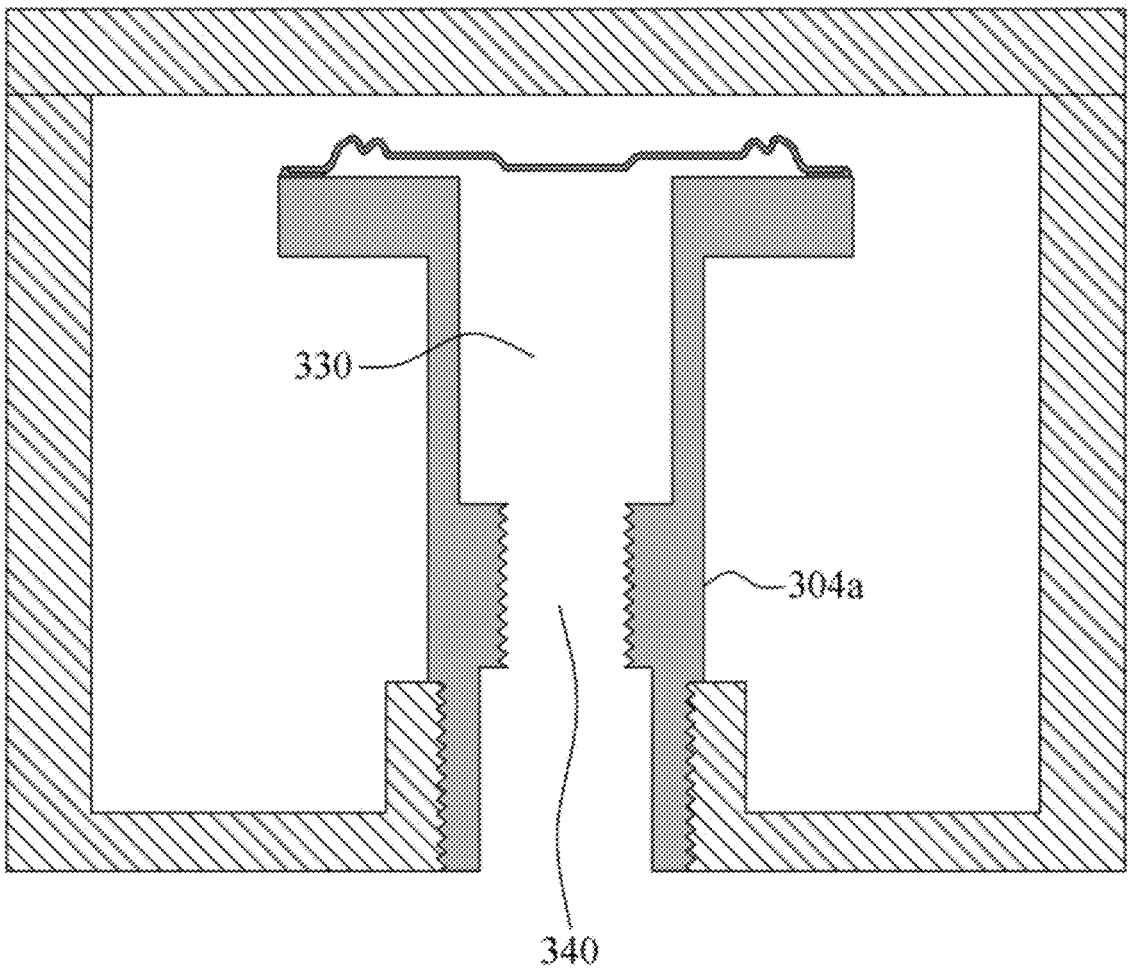
FIG. 11 is a cross-sectional view of an RF cavity filter according to a second disclosed embodiment of the present invention, before the bolt 310 inserted.

FIG. 11 is a cross-sectional view of an RF cavity filter according to the second disclosed embodiment of the present invention, before the bolt 310 inserted.

Referring to FIG. 10 and FIG. 11, a through hole 340 may be formed at the bottom portion 304*a* of the resonator 304, and a bolt 310 may be inserted through the through hole 340 thus formed. At least portions of the inner perimeter of the through hole 340 and the bolt 310 may be threaded, so that the bolt 310 may be rotated and inserted into a blind hole 330 formed in the resonator 304 via a screw joint. The insertion depth may be controlled according to the degree of rotation of the bolt 310.

At an upper portion of the resonator 304, an elastic plate 320 may be attached. The elastic plate may have a relatively larger area compared to the area of the blind hole 330 formed in the resonator 304, and thus, the elastic plate 320 may be attached to the resonator 304 while generally covering the blind hole 330 of the resonator.

While various methods can be used for joining the elastic plate 320 with the upper portion of the resonator 304, some examples may use a method of soldering, welding, brazing, or any of a variety of comparable methods. However, the fastening between the elastic plate 320 and the resonator 304 are not limited to attachment methods, and various fastening methods can be employed to join the elastic plate 320 with the resonator.

The bolt 310 may be inserted in an upward direction through the through hole. As the bolt 310 is inserted upward, the bolt 310 may press the elastic plate 320. When an external force from the bolt 310 is applied on the elastic plate 320, the shape of the elastic plate 320 may be altered due to its elasticity.

For instance, as the bolt 310 applies an external force in an upward direction, the elastic plate 320 may also be stretched in an upward direction. This change in shape of the elastic plate 320 may alter the resonance frequency of the filter, thereby enabling tuning.

The parts that are folded to form the protruding structure and furrowed structure can have a suitably rounded structure.

A more detailed description is provided below regarding changes that occur when the bolt 310 presses the elastic plate 320.

Figure 12A:
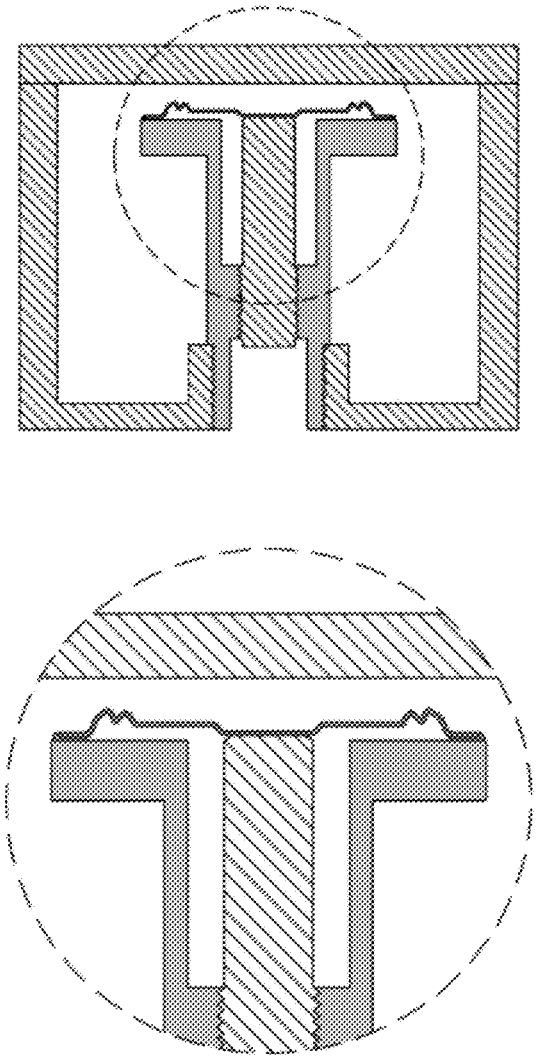
FIG. 12A and FIG. 12B illustrate an RF cavity filter according to a second disclosed embodiment of the present invention, comparing the cases where there is and is not an external force applied by a bolt.
Figure 12B:
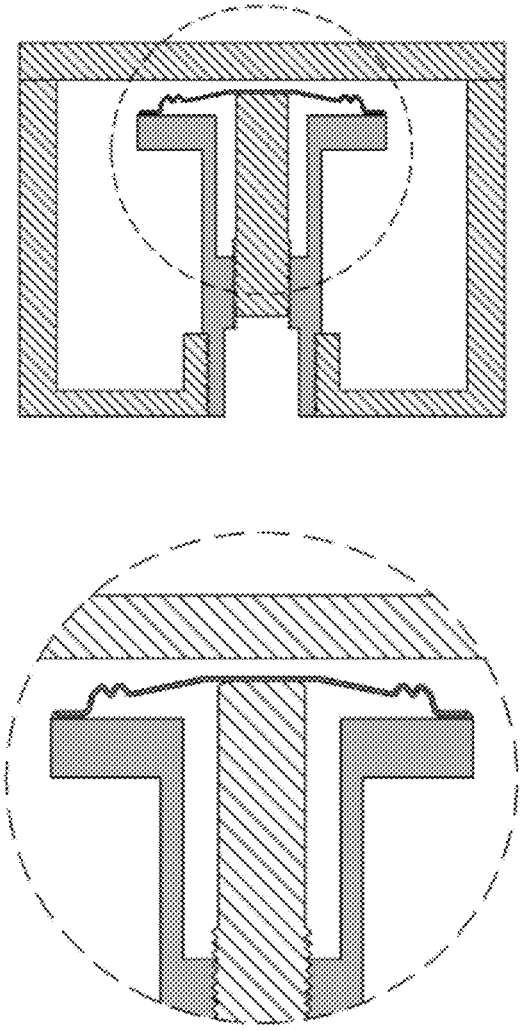

FIG. 12A and FIG. 12B illustrate an RF cavity filter according to the second disclosed embodiment of the present invention, comparing the cases where there is and is not an external force applied by a bolt.

FIG. 12A illustrates the case where there is no external force applied by way of the bolt, and FIG. 12B illustrates the case where there is an external force applied by way of the bolt.

Referring to FIG. 12A, when there is no external force applied by the bolt, the elastic plate 320 may remain in its initial state. As the bolt 310 is continuously rotated, the bolt 310 may be inserted in an upward direction, and once there is contact with the elastic plate 320, the bolt 310 may begin to press the elastic plate 320.

From FIG. 12B, it can be seen that the bolt 310 may press the center area of the elastic plate 320 and that the elastic plate 320 may stretch upward in correspondence to the degree by which the bolt applies pressure, as described above.

As the elastic plate 320 is stretched in an upward direction, the distance between the elastic plate 320 and the cover 300 may be changed. Since the elastic plate 320 is joined to the resonator 304, the elastic plate 320 and the resonator 304 form a substantially integrated structure, and a change in the distance between the elastic plate 320 and the cover 300 means a change in the distance between the resonator 304 and the cover 300.

As the bolt 310 is inserted deeper, the elastic plate 320 may be stretched upward to a greater degree, so that the distance between the elastic plate 320 and the cover 300 may be further decreased.

When such a change occurs in the distance between the elastic plate 320 and the cover 300, a change may occur also in the capacitance component between the elastic plate 320 and the cover 300, and as a result, making it possible to change the resonance frequency. The resonance frequency can be tuned in correspondence to the required conditions by controlling the insertion depth of the bolt. The resonance frequency can be altered by the capacitance value, where the capacitance may be determined by the distance between the elastic plate and the cover. Typically, decreasing the distance between the elastic plate and the cover may cause a downward movement of the resonance frequency, while increasing the distance may cause an upward movement.

Figure 13:
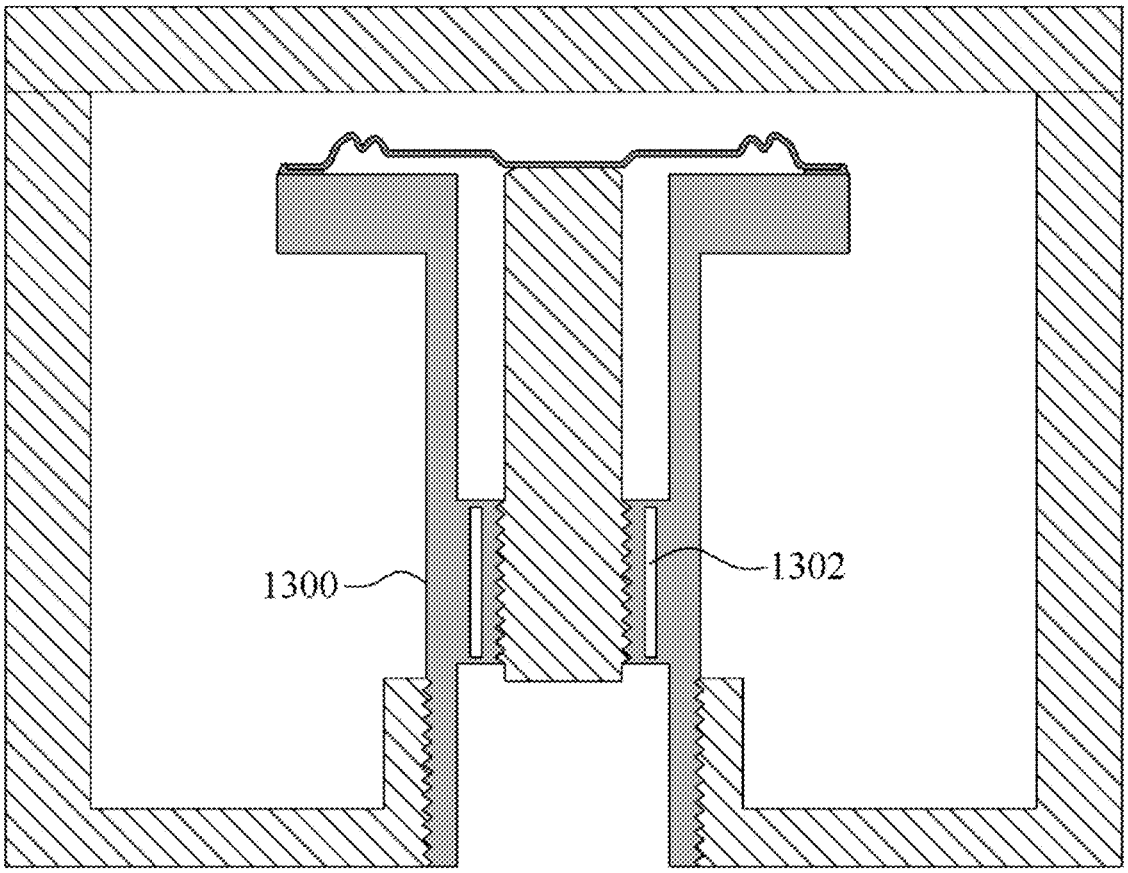
FIG. 13 illustrates the resonator part of an RF cavity filter according to a third disclosed embodiment of the present invention.

FIG. 13 illustrates the resonator part of an RF cavity filter according to a third disclosed embodiment of the present invention.

Compared to an RF cavity filter according to the first disclosed embodiment described above, the structure of an RF cavity filter according to the third disclosed embodiment of the invention additionally includes two holes 1300, 1302 formed in the bottom portion of the resonator.

The first hole 1300 and the second hole 1302 may be holes formed for discharging pieces of metal debris from inside the resonator 304 to the exterior. For example, a nozzle for injecting air may be connected to the first hole 1300, a nozzle for suctioning may be connected to the second hole 1302, and the pieces of metal debris may be suctioned and discharged to the exterior.

While FIG. 13 illustrates an example in which there are two holes formed, it should be apparent to the skilled person that the pieces of metal debris can be discharged via just one hole to which a nozzle for suctioning air may be connected.

Figure 14:
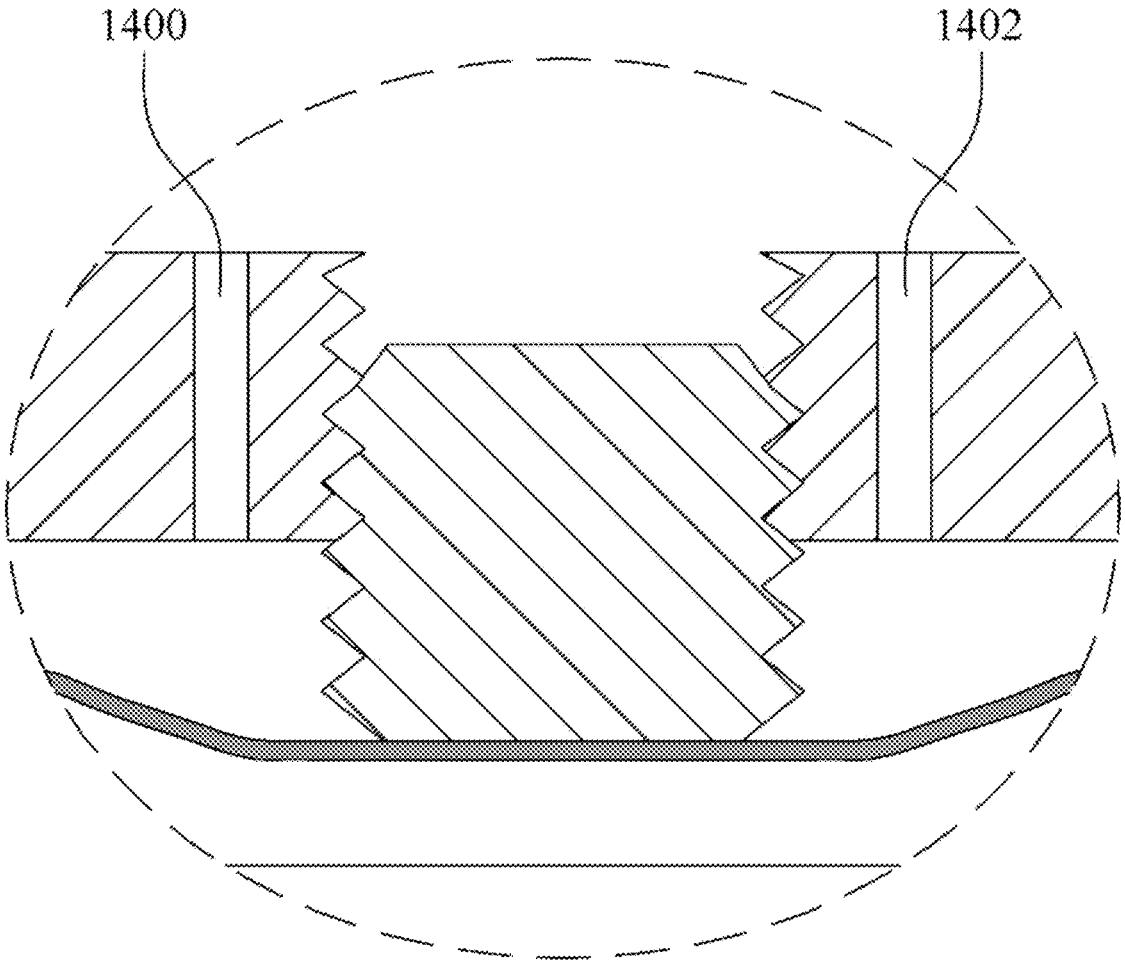
FIG. 14 illustrates the cover part of an RF cavity filter according to a fourth disclosed embodiment of the present invention.

FIG. 14 illustrates the cover part of an RF cavity filter according to a fourth disclosed embodiment of the present invention.

Compared to an RF cavity filter according to the second disclosed embodiment described above, the structure of an RF cavity filter according to the fourth disclosed embodiment of the invention additionally includes two holes 1400, 1402 formed in the cover.

The two holes 1400, 1402 can be formed on either side of the bolt and may be formed within the area of the elastic plate.

The first hole 1400 and second hole 1402 may be holes formed for discharging pieces of metal debris located between the cover and the elastic plate to the exterior. For example, a nozzle for injecting air may be connected to the first hole 1400, a nozzle for suctioning may be connected to the second hole 1402, and the pieces of metal debris may be suctioned and discharged to the exterior.

While FIG. 14 illustrates an example in which there are two holes formed, it should be apparent to the skilled person that the pieces of metal debris can be discharged via just one hole to which a nozzle for suctioning air may be connected.

The descriptions of the present invention provided above are for illustrative purposes only, and the person having ordinary skill in the field of art to which the present invention pertains would understand that various specific implementations can be derived without departing from the technical spirit or essential features of the present invention.

In particular, it should be apparent to the skilled person that a bolt 310 can be substituted by a bar in the embodiments set forth above.

Thus, the embodiments described above are illustrative in all aspects and do not limit the present invention.

In some examples, a component described as a single unit can be practiced in a distributed form, and likewise, components described as a distributed form can be practiced in an integrated form.

The scope of the present invention is defined by the scope of claims set forth below, and all modifications or variations derived from the interpretation and scope of the claims and their equivalent concepts are to be interpreted as being encompassed within the scope of the present invention.

What is claimed is:

1. An RF cavity filter comprising:

a housing having at least one cavity formed therein;

a cover joined to an upper portion of the housing;

at least one bolt inserted through at least one through hole formed in the cover; and at least one elastic element attached to the cover in an area below the at least one through hole, wherein the at least one bolt is inserted through the at least one through hole to provide an external force on the elastic element, and the external force alters a shape of the at least one elastic element, wherein the at least one elastic element has a generally plate-like form and has a partially downwardly protruding structure and a furrowed structure, and wherein the at least one elastic element has the partially downwardly protruding structure and the furrowed structure in an area other than an area of contact with the at least one bolt.

2. The RF cavity filter of claim 1, further comprising at least one resonator held in the at least one cavity.

3. The RF cavity filter of claim 2, wherein threads are formed in an outer perimeter of the at least one bolt and an inner perimeter of the at least one through hole, and the at least one bolt is inserted downward by rotation to provide the external force on the at least one elastic element.

4. The RF cavity filter of claim 2, wherein the furrowed structure includes a structure having a plurality of furrows formed concentrically.

5. The RF cavity filter of claim 4, wherein the furrowed structure having a concentric form is configured to have a diameter relatively smaller than the at least one resonator.

6. The RF cavity filter of claim 1, wherein the at least one elastic element is configured to have a size relatively larger than the at least one through hole, and the at least one elastic element is attached to the cover by at least one of soldering, welding, and brazing applied to an edge area of the at least one elastic element.

7. The RF cavity filter of claim 1, wherein the at least one bolt contacts a center area of the elastic element to provide the external force on the at least one elastic element.

8. The RF cavity filter of claim 1, wherein the cover has at least one hole formed therein for discharging pieces of debris created during tuning of the RF cavity filter.

9. An RF cavity filter comprising:

a housing having at least one cavity formed therein;

a cover joined to an upper portion of the housing;

at least one resonator joined to a bottom portion of the cavity; and at least one elastic element attached to an upper portion of the at least one resonator, wherein the at least one elastic element is altered in shape by an external force, and wherein the at least one resonator has a through hole formed therein, a bar is inserted through the through hole, and the bar provides the external force on the at least one elastic element as the bar is inserted.

10. The RF cavity filter of claim 9, wherein the at least one elastic element has a generally plate-like form and has a partially protruding structure and a furrowed structure.

11. An RF cavity filter comprising:

a housing having at least one cavity formed therein;

a cover joined to an upper portion of the housing;

at least one bar inserted through at least one through hole formed in the cover; and at least one elastic element joined to a lower portion of the cover, wherein the elastic element is altered in shape by an external force, wherein the at least one bar provides the external force on the at least one elastic element as the bar is inserted, wherein the at least one elastic element has a generally plate-like form and has a partially downwardly protruding structure and a furrowed structure, and wherein the elastic element has the partially downwardly protruding structure and the furrowed structure in an area other than an area of contact with the at least one bar.

12. An RF cavity filter comprising:

a housing having at least one cavity formed therein;

a cover joined to an upper portion of the housing;

at least one resonator joined to a bottom portion of the at least one cavity;

at least one bolt inserted through at least one through hole formed in the at least one resonator; and at least one elastic element attached to an upper portion of the at least one resonator, wherein the at least one bolt is inserted through the at least one through hole to provide an external force on the elastic element, and the external force alters a shape of the at least one elastic element.

13. The RF cavity filter of claim 12, wherein the at least one elastic element has the partially protruding structure and the furrowed structure in an area other than an area of contact with the at least one bolt.

14. The RF cavity filter of claim 12, wherein threads are formed in an outer perimeter of the at least one bolt and an inner perimeter of the at least one through hole, and the at least one bolt is inserted upward by rotation to provide the external force on the at least one elastic element.

15. The RF cavity filter of claim 12, wherein the resonator has a blind hole formed therein for receiving the at least one inserted bolt, the elastic element is configured to have a size relatively larger than the blind hole, and the at least one elastic element is attached to the resonator by at least one of soldering, welding, and brazing applied to an edge area of the at least one elastic element.

16. The RF cavity filter of claim 12, wherein the at least one elastic element has a generally plate-like form and has a partially protruding structure and a furrowed structure.

* * * * *